United States Patent [19]

Verbickas

[11] 4,156,359

[45] May 29, 1979

[54] METHOD OF OPERATION OF CROWN ADJUSTMENT SYSTEM DRIVES ON CLUSTER MILLS

[75] Inventor: Robert C. Verbickas, Wolcott, Conn.

[73] Assignee: T. Sendzimir, Inc., Waterbury, Conn.

[21] Appl. No.: 843,403

[22] Filed: Oct. 19, 1977

[51] Int. Cl.[2] ..... B21B 13/14; B21B 31/00

[52] U.S. Cl. ..... 72/243

[58] Field of Search ..... 72/243, 242, 244, 238, 72/239, 248

[56] References Cited

U.S. PATENT DOCUMENTS

| | | | |
|---|---|---|---|
| 3,528,274 | 9/1970 | Rastelli | 72/242 |
| 3,691,810 | 9/1972 | Sendzimir | 72/243 |
| 3,858,424 | 1/1975 | Kajiwara et al. | 72/242 |

*Primary Examiner*—Milton S. Mehr

*Attorney, Agent, or Firm*—Melville, Strasser, Foster & Hoffman

[57] ABSTRACT

In a cluster mill having independently adjustable eccentrics on each saddle on at least one backing shaft to adjust the roll gap in line with each saddle, means to adjust the eccentrics in synchronism to produce a tapered roll gap and separate means to adjust the eccentrics in synchronism to produce a crowned roll gap, and, in combination, means to produce a roll gap with a composite crowned and tapered form.

5 Claims, 7 Drawing Figures

METHOD OF OPERATION OF CROWN ADJUSTMENT SYSTEM DRIVES ON CLUSTER MILLS

BRIEF SUMMARY OF THE INVENTION

This invention relates to cold rolling cluster mills of the general type shown in Sendzimir U.S. Pat. Nos. 2,169,711; 2,187,250; 2,194,212 and 2,776,586.

The object of this invention is to provide improvements in the construction of such mills, with the objective of increasing the ability of these mills to roll strip which has a tapered or crowned profile, or a combination of both.

Tapered or wedge shaped strip frequently has to be rolled on cold mills. Such strip is produced when crowned strip is slit into two or more narrower widths. Also the crowned strip produced by hot strip mills does not necessarily have a symmetrical crown, as such deficiencies as errors in screwdown setting, effect of drive spindle weight, and so on, can cause an imbalance on the hot mill.

In the specification of U.S. Pat. No. 2,194,212 means of adjusting the contour of the rolls (and hence of the roll gap) are disclosed. Such means are incorporated in most modern Sendzimir cluster mills and embody individual drives (so-called crown adjustment drives) to each shaft support (saddle) on at least one backing shaft to adjust the position of the shaft at the saddle in a sense to increase or decrease the roll gap in line with the saddle. As there may be from four to eight saddles, or even more, depending on the width of the mill, it is possible to achieve a very fine control of the profile of the roll gap.

Clearly it is theoretically possible by this means to set a roll gap having a tapered profile. However, in practice this is found to be impossible, because the operator needs to adjust from four to eight drives (depending on the number of saddles) simultaneously and all at different speeds.

The present invention comprises means to operate and synchronize the rotation of the crown adjustment eccentrics on Sendzimir cluster mills so that the operator can conveniently control the rotation of the eccentrics to produce tapered and/or crowned roll gap profiles. The improvement lies in the fact that existing methods (such as that described in U.S. Pat. No. 4,022,040) give synchronized adjustment for crown or for wedge control, but not for both together.

DETAILED DESCRIPTION

Figure 1:
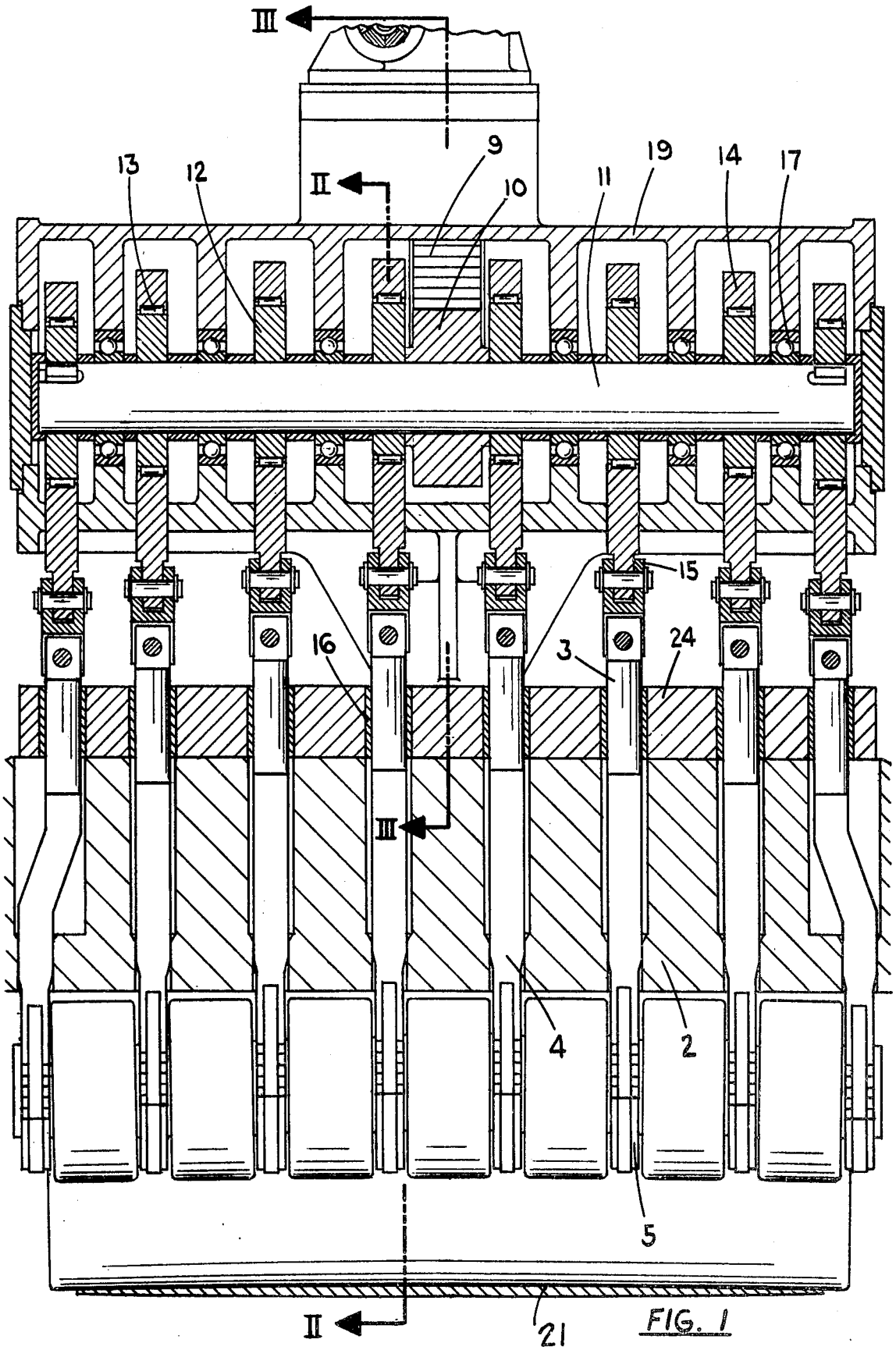
FIG. 1 is a longitudinal sectional elevation of a profile adjusting system incorporating an embodiment of the present invention.

The drawings are given by way of example only and are not intended to limit the scope of the invention.

Cold rolling cluster mills of the general type described in the above noted patents consist of a pair of work rolls each of which is supported by a plurality of intermediate rolls, the intermediate rolls themselves being supported in turn by a plurality of backing assemblies which are supported by the mill frame. Each backing assembly (see FIGS. 1 and 2) consists of a plurality of bearings or casters 1 mounted on a stationary shaft 6. The shaft 6 is supported at intervals throughout its length by stationary saddles 17. The intermediate rolls are supported by the bearings 1 and the saddles are supported by the mill frame. On at least one of the backing assemblies the stationary shaft is eccentrically mounted in each saddle and the shaft can be bent and/or tilted by rotating the eccentrics 20 individually according to the prior art. Each of the eccentrics is provided with a gear 5 and a rack 4 engaging the gear and the rack is traversed in order to rotate the gear and the eccentric.

Figure 2:
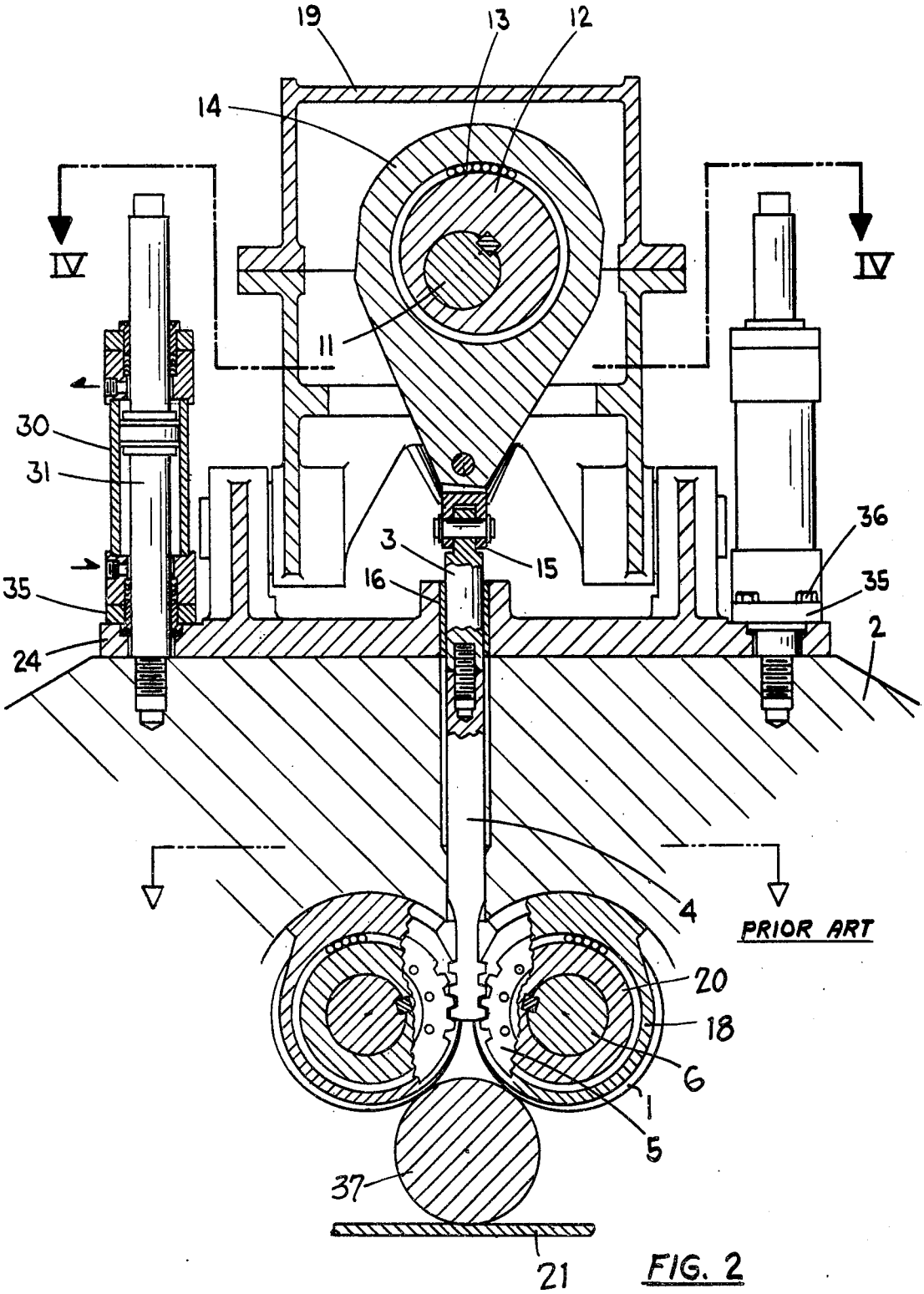
FIG. 2 is a transverse sectional elevation taken substantially along line II—II of FIG. 1 showing the relation between the profile adjusting system and the rolling mill.

In FIG. 1 and FIG. 2 an embodiment of the subject system is shown mounted on a cluster mill housing 2, shown in partial section. Connecting rods 3 which are the outputs of the system are attached to racks 4 engaging with gears 5. Racks 4 and gears 5 are provided at several positions across the width of the strip being rolled by the mill and vertical movements of racks 4 can be used to form a profiled roll gap within the mill, according to the prior art, by rotating gears 5 whose shafts are eccentrically mounted.

The system of the invention has the function of moving racks 4 via connecting rods 3 in a synchronized manner so as to form the desired roll gap profile.

In FIG. 1 which shows an embodiment for a system installed on a cluster mill having eight saddles on each backing shaft. A work roll is indicated at 37, and the rolled strip appears in transverse section at 21. The left side of FIG. 1 represents the back of the mill and the right side represents the front, which is where the operator stands. This is conventional cluster mill terminology. The corresponding eight connecting rods 3 can be seen projecting below the bottom surface of the assembly. Said rods are guided in bushings 16 so that they can only move in a vertical direction.

The system consists of three main subsystems to perform the three separate functions of (A) synchronized crown adjustment, (B) synchronized wedge adjustment, and (C) raising of racks 4 to enable backing assemblies to be replaced.

Subsystem (A) consists of frame 19 and shaft 11, eccentrics 12, gear 10 and all other components mounted in said housing, together with motor 7 and jack 8 mounted thereon (shown on FIG. 3) and links 14, lower links 15 and connecting rods 3 depending therefrom.

Figure 5:
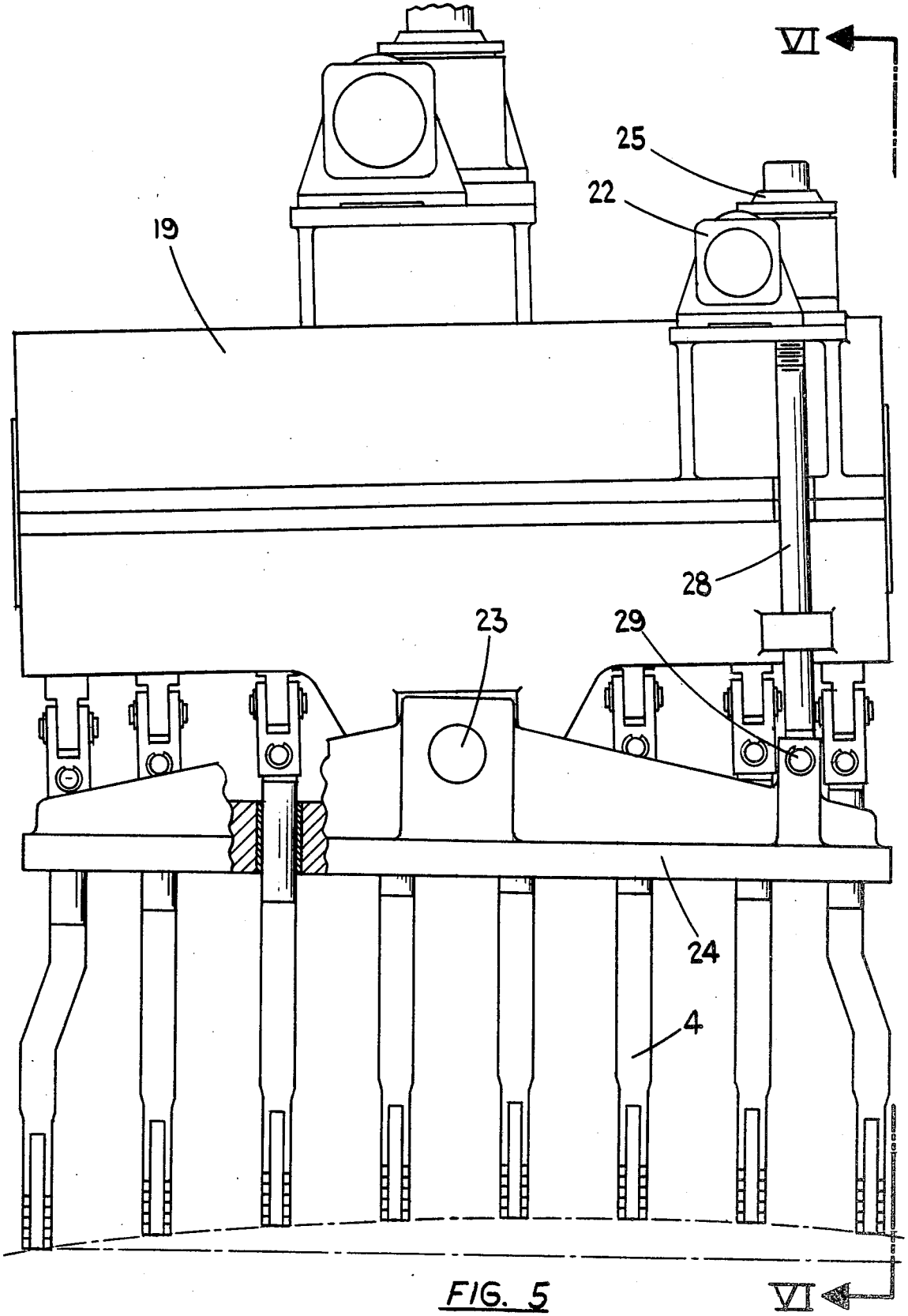
FIG. 5 is a longitudinal elevation partially broken away showing the effect of operating the profile adjusting mechanism to obtain a composite profile of wedge and crown.
Figure 6:
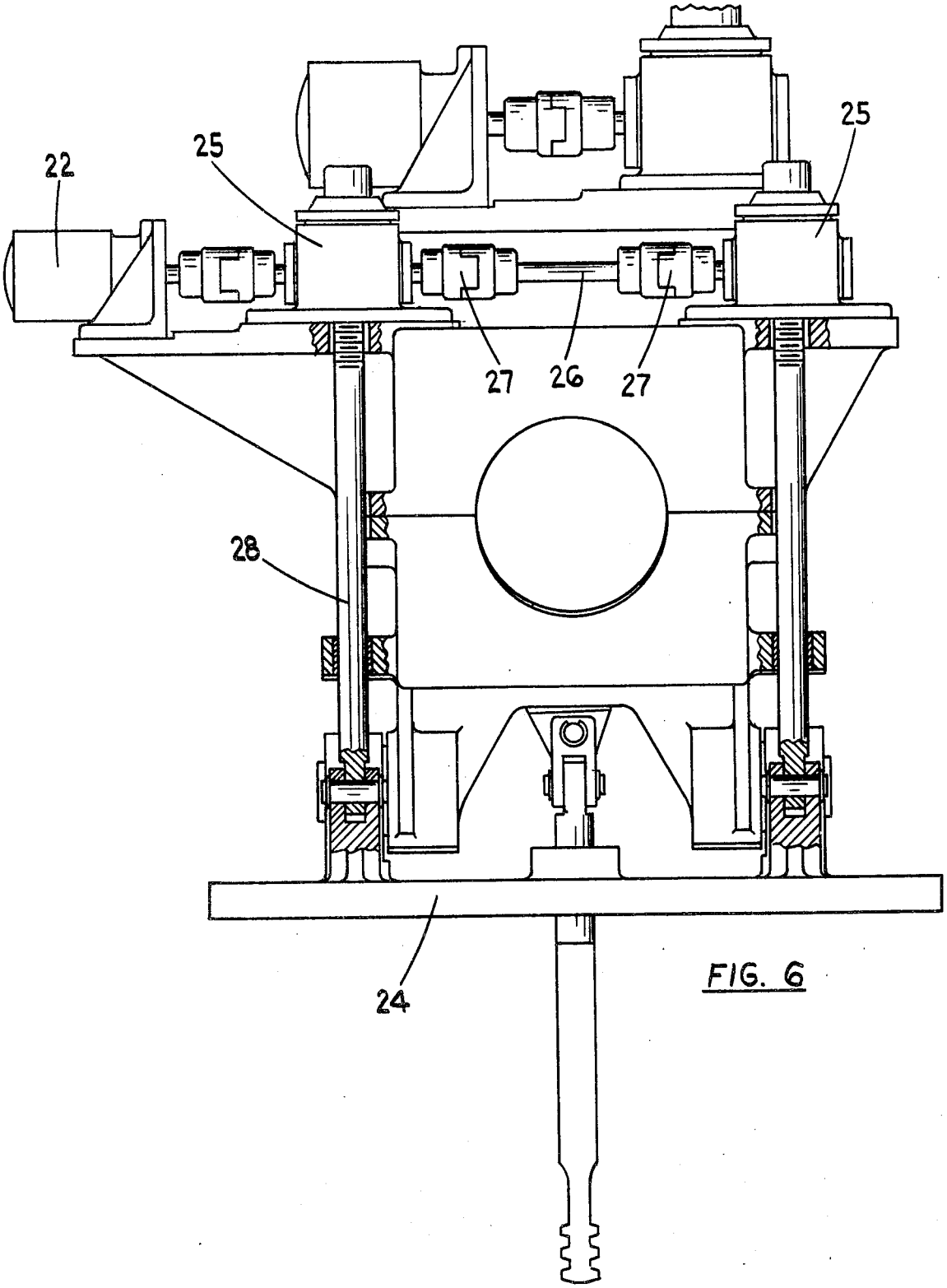
FIG. 6 is an end view taken along line VI—VI of FIG. 5 showing a mechanism for adjusting the wedge profile by the profile adjusting system.

Subsystem (B) consists of a mechanism for tilting subsystem (A), and is shown in FIGS. 5 and 6.

Subsystem (C) consists of a mechanism for lifting subsystems (A) and (B) together with racks 4.

Figure 3:
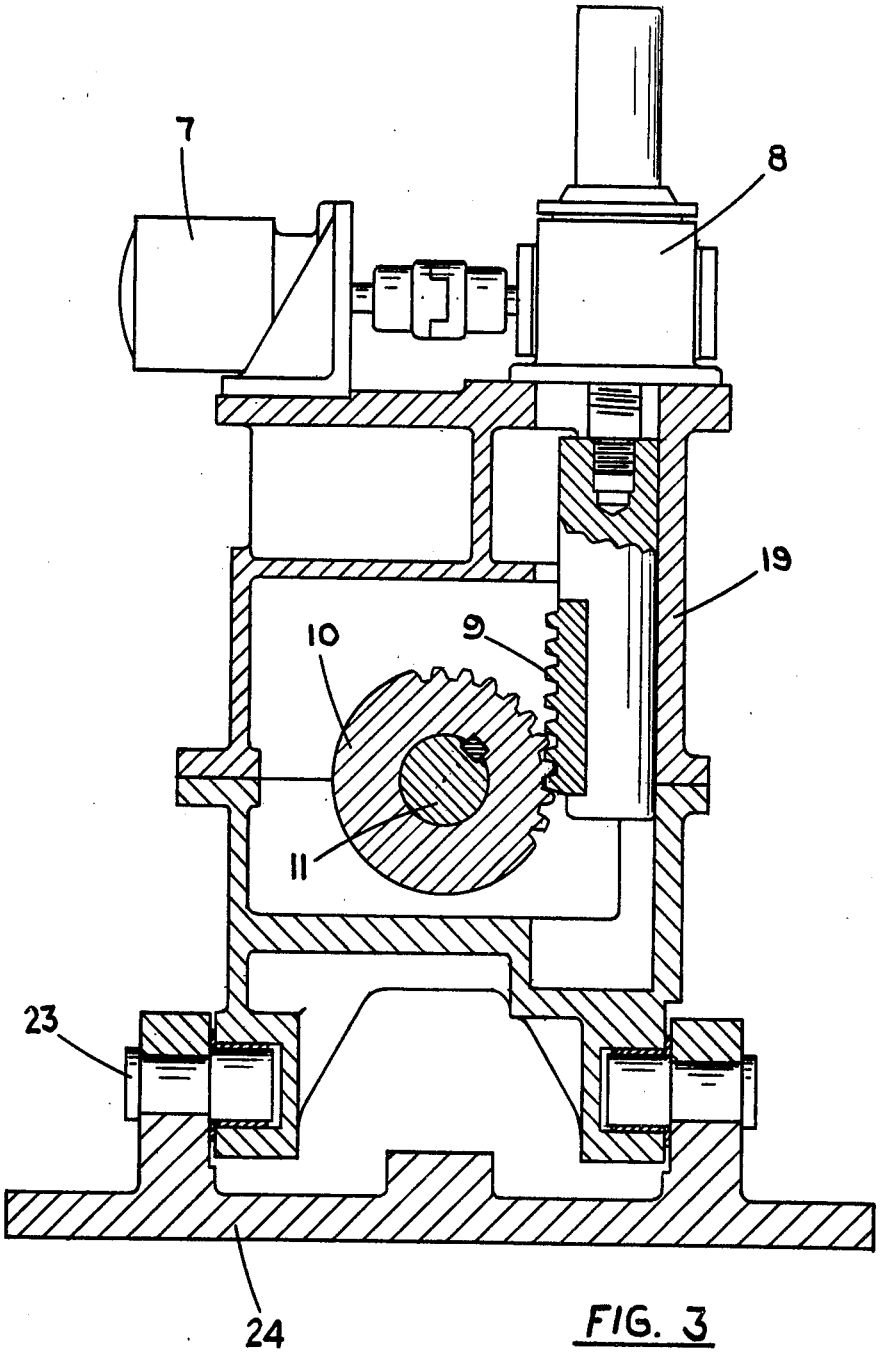
FIG. 3 is a transverse sectional view taken substantially along line III—III of FIG. 1 showing a mechanism for adjusting the crown profile by the profile adjusting system.
Figure 4:
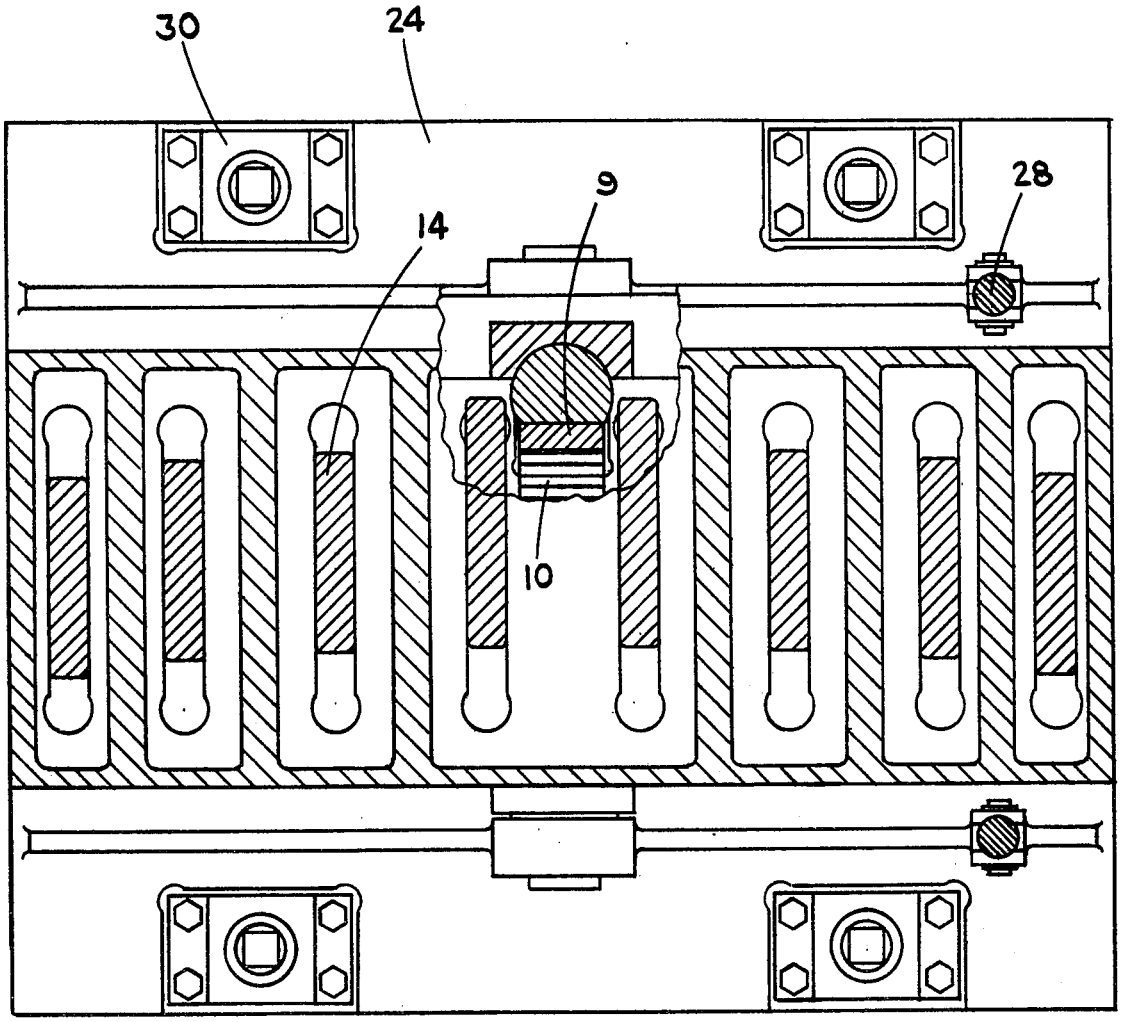
FIG. 4 is a plan section of the profile adjusting system taken substantially along line IV—IV of FIG. 2 partially broken away.

Synchronized motion of rods 3 in order to produce a crowned roll gap profile, subsystem (A), is as follows. Motor 7 (as viewed in FIG. 3) drives the input shaft of worm jack 8. The output or lifting shaft of said jack is attached to rack 9 as shown in FIG. 3. As said rack is raised and lowered, it causes gear 10 and shaft 11, to which said gear is keyed, to rotate. Shaft 11 is supported in frame 19 by bearings 17.

A set of eight eccentrics 12 are also keyed to shaft 11 (FIG. 1). Each of said eccentrics is rotatably mounted within a link 14, relative rotation between said eccentric and said link being provided for by needle rollers 13 interposed in the annular space between the outer cylindrical surface of said eccentric and the bore of said link. A lower link 15 connects each link 14 with its corresponding connecting rod 3, and allows for tilting of link 14 in any direction.

The rotation of shaft 11 causes the eight connecting rods 3 to raise or to lower, depending on the direction of motion, and these movements produce a resultant profile of the roll gap, the form of the profile depending on the eccentricity and phase relationship of the eight eccentrics 12.

Each of the eccentrics has a maximum radius and a minimum radius, as measured from the center of the shaft to the outer surface. These radii are 180° apart. At right angles to these radii, the radii are between maximum and minimum, and are referred to herein as average radii.

Preferably all the eccentrics are mounted in phase. This means that the average radii of all the eccentrics are in alignment. However, the eccentricities of the individual eccentrics are varied. If a parabolic profile is desired, the eccentricities of the eccentrics would be in the ratio of −3:0:+2:+3:+3:+2:0:−3.

It will be understood that when the shaft 11 is oriented so that the average radii are acting on the connecting rods 3, a straight profile will be produced. As the shaft 11 is rotated in one direction, a crown will be produced; and the further the shaft 11 is rotated, the higher the crown. Rotation of the shaft 11 in the opposite direction will, in the same way, produce a negative crown.

Operation of subsystem (B) to obtain synchronized motion of rods 3 in order to produce a tapered roll gap profile is as follows. See FIG. 5 and FIG. 6. Frame 19 is provided with four points of support. It is pivoted at its center line on pivot pin 23 (in line with the center of the rolling mill) and is also provided with two legs 28 which have pin joints 29 on the same horizontal plane as said pivots. Pivots 23 and pin joints 29 are mounted on base plate 24, said base plate being normally clamped to the top of the mill housing by hydraulic cylinders 30 (as shown in FIG. 2).

Frame 19 can be tilted about its center line by varying the length of legs 28. This is achieved by operation of motor 22 driving jacks 25 which are synchronized together by shaft 26 and couplings 27.

If the shaft 11 is oriented so that the average radii are acting on the connecting rods 3, producing a straight profile, and the frame 19 is then tilted, the resulting respective vertical displacements of the connecting rod 3 and racks 4 will be in the ratios of −7:−5:−3:−1:+1:+3:+5:+7, which is the correct relationship to produce a tapered roll gap. If the shaft 11 has been rotated to produce a parabolic roll gap (subsystem A), and the frame 19 is then tilted (subsystem B), there is produced an asymmetrical roll gap as shown in chain lines at the bottom of FIG. 5. This is, in effect, a parabola on a tilted axis.

Figure 7:
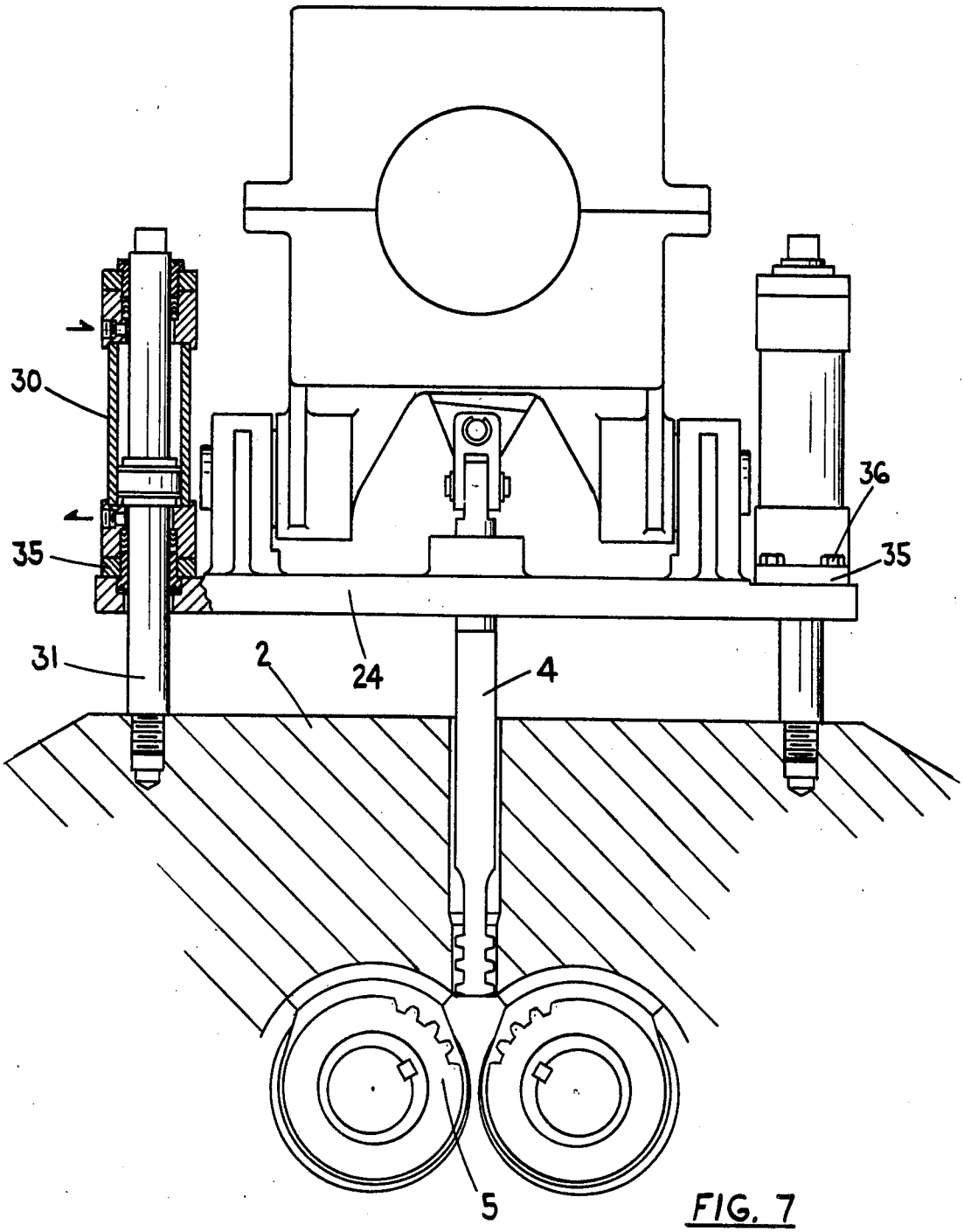
FIG. 7 is an end view partially broken away showing a mechanism for retracting the profile adjusting system enabling backing elements to be inserted and removed from the rolling mill.

Operation of subsystem (C) in order to raise subsystems (A) and (B) and racks 4 to enable backing assemblies to be replaced is carried out as follows (see FIG. 2 and FIG. 7). The four hydraulic cylinders 30 are of the double rod type, and the lower rods 31 are attached to the mill housing 2 by means of the threaded ends on said rods. Each cylinder body 30 is attached to base plate 24 by means of flange 35 and screws 36. During normal operation of the mill, the lower ends of cylinders 30 are pressurized and the upper ends of said cylinders are vented. The cylinders thus act as hydraulic clamps and maintain the complete system tightly mounted on top of the mill housing in a fixed position. In order to raise subsystems (A) and (B) and racks 4, the upper ends of cylinders 30 are pressurized and the lower ends vented. Said cylinders thus act as hydraulic jacks and raise the complete assembly, including base plate 24, clear of the mill housing by a distance determined by the stroke of said cylinders. This action is shown by comparing FIG. 2 with FIG. 7. In FIG. 7 it can be seen that raising the assembly has the effect of withdrawing racks 4 so they disengage completely from gears 5. The backing shaft assemblies on which gears 5 are mounted can then be removed from the mill and replaced with spare assemblies. At this stage racks 4 and gears 5 can be reengaged by pressurizing the lower ends of hydraulic cylinders 30 and venting the upper ends of said cylinders. The complete assembly will then be lowered until said racks and gears reengage, and it will continue to lower (rotating gears 5 in the process) until base plate 24 contacts mill housing 2 and becomes clamped thereupon, (as shown in FIG. 2).

The system shown in the drawings is given by way of example only. Clearly the action of system (A) could be obtained by use of a system of gears rather than eccentrics and the system adopted is purely a matter of convenience.

To help the operator make full and proper use of the system, it is envisaged that indicating devices (remote and/or local) would be provided. These could indicate rotation of motor 7 (crown only) and of motor 22 (wedge only) or of linear motion of connecting rods 3 (crown, wedge and removal position indication). Such methods of indication are well known in the state of the art and need not be considered here.

I claim:

1. In a cluster mill having upper and lower backing shafts, and individual drives on at least one of the backing shafts, to adjust the roll gap in line with each saddle, first means for mechanically synchronizing the drives such that they act together to form a symmetrical roll gap profile which will be flat when said drives are in a neutral position, convex when they are operated in one direction, and concave when they are operated in the other direction, the magnitude of the convexity or concavity being proportional to the synchronized movement of the drives away from their neutral position for which the roll gap is parallel, together with second means for mechanically synchronizing the drives such that they act together to form a roll gap which tapers down from front to back of the mill when operated in one direction, and which tapers down from back to front when operated in the other direction, the magnitude of the taper being proportional to the synchronized movement of the drives away from their neutral position for which the roll gap is parallel, said first and second means being operable separately or simultaneously to obtain any desired combination of taper and crown in the roll gap.

2. In a cluster mill having upper and lower backing shafts, and a number of rack and gear driven saddles on at least one of the backing shafts, to adjust the roll gap in line with each saddle, a drive system for said racks and gear driven saddles including a first synchronized drive means consisting of a motor, jack, rack and pinion which are used to rotate a shaft, said shaft being connected to some or all of said rack and gear driven saddles, by means of eccentrics and links, whereby synchronously to move said saddles away from their positions in which the roll gap is parallel, to positions in which the roll gap is profiled, and also including a second synchronized drive means consisting of a motor, jack and a pivoting assembly, said assembly being connected to all of said rack and gear driven saddles by means of said links, whereby synchronously to move saddles away from their positions in which the roll gap is parallel, to positions in which the roll gap is tapered, said first and second synchronized drive means being operable separately or simultaneously to obtain any desired combination of taper and crown in the roll gap.

3. In a cluster mill having upper and lower backing shafts and a number of rack and gear driven saddles on at least one of the backing shafts to adjust the roll gap in line with each saddle, a drive system consisting of a number of eccentrics being fixed in phase on a common shaft, with the several eccentrics having different eccentricities, each eccentric being linked to one of said racks by means of a connecting link, means for rotating said shaft in either direction from a neutral position whereby to produce a parallel roll gap in said neutral position, a positive crown roll gap in one direction, or a negative crown roll gap in the other direction.

4. A cluster mill according to claim 3, wherein a frame containing said saddles and eccentrics is mounted for tilting movement in either direction from a neutral parallel position, whereby if said eccentrics are in their neutral position the roll gap may be made tapering from front to rear of the mill by tilting in one direction, and from rear to front of the mill by tilting in the other direction, and whereby if said eccentrics are oriented to produce a positive or negative crown roll gap, the axis of said crown may be shifted angularly.

5. A cluster mill according to claim 4, wherein said frame is mounted on a base plate, and means are provided to clamp said base plate to the mill housing, and to raise said base plate from said mill housing, whereby upon raising said plate from the mill housing, the racks are withdrawn from said gear driven saddles to permit replacement of the backing shaft assemblies.

* * * * *